US008650697B2

(12) United States Patent
Lombardi

(10) Patent No.: US 8,650,697 B2
(45) Date of Patent: Feb. 18, 2014

(54) TOOTHBRUSH

(76) Inventor: Stephen Lombardi, Bronx, NY (US)

( * ) Notice: Subject to any disclaimer, the term of this patent is extended or adjusted under 35 U.S.C. 154(b) by 391 days.

(21) Appl. No.: 12/927,652

(22) Filed: Nov. 20, 2010

(65) Prior Publication Data

US 2012/0124765 A1 May 24, 2012

(51) Int. Cl.
*A46B 9/04* (2006.01)

(52) U.S. Cl.
USPC ..... 15/167.1; 15/143.1

(58) Field of Classification Search
USPC ..... 15/167.1, 143.1, 185, 105, 22.1, 28
See application file for complete search history.

(56) References Cited

U.S. PATENT DOCUMENTS

| | | | | |
|---|---|---|---|---|
| 1,956,477 | A * | 4/1934 | Segal | 15/185 |
| 2,247,003 | A * | 6/1941 | Smith et al. | 401/191 |
| 2005/0274906 | A1 * | 12/2005 | Riddell | 250/455.11 |
| 2009/0083924 | A1 * | 4/2009 | Shepherd et al. | 15/105 |

FOREIGN PATENT DOCUMENTS

| | | |
|---|---|---|
| CN | 2699728 Y | 5/2005 |

* cited by examiner

*Primary Examiner* — Robert Scruggs
(74) *Attorney, Agent, or Firm* — Henry M. Feiereisen, LLC

(57) ABSTRACT

A toothbrush has a body having one end provided with a toothbrushing element and another opposite end, the body also having at least a part formed so that when the toothbrush is inclined, even close to a horizontal position, it automatically turns back to a substantially vertical orientation to prevent a contact of the toothbrushing element with a supporting surface.

5 Claims, 2 Drawing Sheets

TOOTHBRUSH

BACKGROUND OF THE INVENTION

The present invention relates generally to toothbrushes.

Toothbrushes are widely used for brushing teeth and known in many modifications. It is advisable to hold the toothbrush, when not in use, in a vertical position to prevent contamination of bristles from contact with surrounding surfaces. For this purpose the toothbrushes in bathrooms and other spaces are held in vertical containers, holders, etc.

A toothbrush is also known (CN 2699728Y) which is designed with a round lower end and a weight layer, such that when the toothbrush is deviated from the upright position, it returns to and stands in the substantially upright position itself, without additional containers, holders, etc. It is believed that the existing toothbrushes can be further improved.

SUMMARY OF THE INVENTION

Accordingly, it is an object of the present invention to provide a toothbrush which is a further improvement of the existing toothbrushes.

In keeping with these objects and with others which will become apparent hereinafter, one feature of the present invention resides, briefly stated, in a toothbrush, comprising a body having one end providing with a toothbrushing element and another opposite end, said body having at least a part formed so that when the toothbrush is inclined from a vertical orientation, even close to a horizontal orientation it automatically turns back to a substantially vertical orientation to prevent a contact of said toothbrushing element with a supporting surface on which the toothbrush is placed.

When the toothbrush is designed in accordance with the present invention, it automatically returns back to a substantially upright position, thus preventing contamination of the toothbrushing element (bristles) from contact with the supporting surface.

In accordance with a further feature of the present invention, in order to provide the self-return of the toothbrush to the upright position from any position which can be close even to a horizontal position, a lower part of the toothbrush is formed bulb-shaped (bulbous) with an upper narrow portion and a lower wider portion having a curvilinear surface, and the weight of the lower part is selected to provide said self-return. The upper part however can be narrow and of identical width along its height.

In accordance with still a further feature of the present invention, the body of the toothbrush is composed of separate upper and lower parts, which are connected turnably relative to one another.

In accordance with another feature of the present invention in the toothbrushes said upper part is turnable between several positions including a first position in which the toothbrushing element is located substantially at an upper location, a second position in which said toothbrushing element faces downwardly to allow dripping from the latter, and a third position in which said toothbrushing element is located in a lower location.

In accordance with a further feature of the invention said lower part has a recess in which said toothbrushing element is located in said lower location, and an ultraviolet light source is associated with said recess such that said toothbrushing element is sterilized by ultraviolet light emitted by said ultraviolet light source when said toothbrushing element is located in said recess.

Another feature of the present invention is that said upper part is turnable relative to said lower part, and pivot means turnably connect said upper part with said lower part. The pivot means can be formed to provide a tight-fit connection between said upper and lower parts, such that said upper part can turn relative to said second part and stay in a plurality of positions by the tight fit.

An additional feature of the present invention is that the toothbrushes has a light source arranged on said body, and said light source is programmed to be on, for example, substantially only for a period of time recommended for toothbrushing.

In accordance with the further feature, said upper part which carries the toothbrushing element is removably connected with said lower part which forms the support, so that it can be removed from said lower part and replaced by a new upper part.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
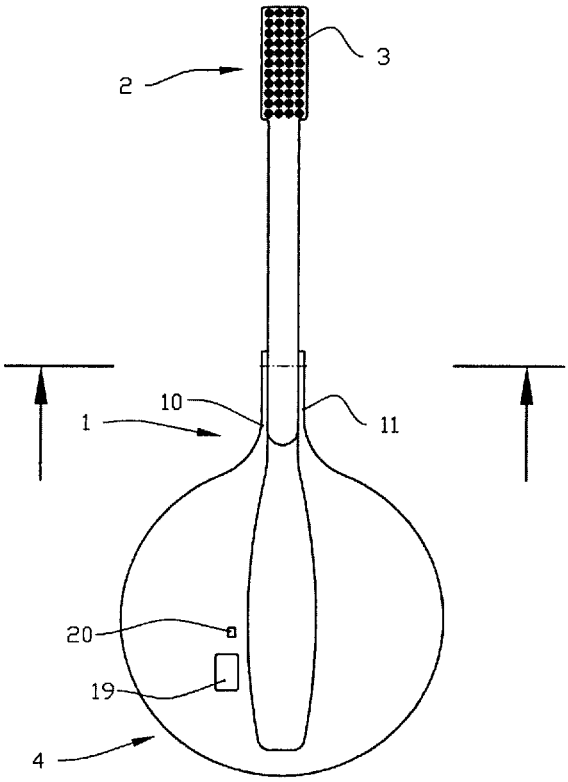
FIG. 1 is a front view of a toothbrush in accordance with the present invention.
Figure 2:
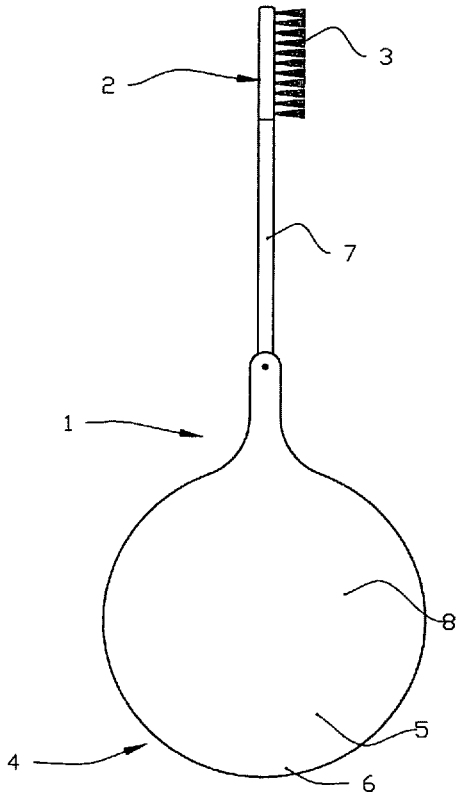
FIG. 2 is a side view of the toothbrush in accordance with the present invention.

A toothbrush in accordance with the present invention has a body which is identified as a whole with reference numeral 1. The body 1 has a first end 2 provided with a toothbrushing element 3 formed for example by bristles, and an opposite second end 4.

The body 1 is formed so that it is kept substantially upright, and even if it is inclined close to a substantially horizontal position on a supporting surface, it turns back automatically by itself, to assume a substantially upright orientation, to prevent a contact of the toothbrushing element 3 with unclean supporting surfaces. For this purpose an upper part 7 of the toothbrush body 1, which carries the toothbrushing element 3 is connected with a lower part 8 which is bulb-shaped (bulbous) and has an upper narrow portion and a lower wider portion 5, a significant weight, and a low location of the center of gravity of the toothbrush body 1.

The lower wider portion 5 of the lower part 8 has a curvilinear surface, which can be formed, for example, as a part-spherical surface. This curvilinear surface can be formed by rotating of a convex generatix around a vertical axis.

Figure 3:
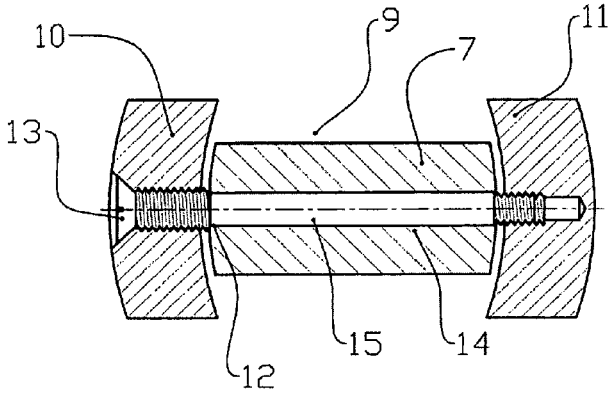
FIG. 3 is a view showing a cross-section of the toothbrush in accordance with the present invention along the line I-I in FIG. 1.

The upper part 7 and the lower part 8 can be formed as separate elements, which are connected with one another by connecting means formed for example as shown in FIG. 3.

The lower portion of the upper part 7 is inserted in a gap 9 between two upper projections 10 and 11 of the lower part 8.

A threaded pin 12 with a head 13 is screwed into the projection 10, passes through an opening 14 in the upper part 7, and is screwed into the projection 11. In a portion 15 between the projections 10 and lithe threaded pin 12 can be threadless. The outer diameter of threadless portion 15 of the pin 12 and the inner diameter of the opening 14 of the upper part 7 can be selected so as to form a tight fit, for the purpose which will be explained herein below. The left and right ends of the pin 12 do not extend outwardly beyond the projections 10 and 11 to prevent any injuries to a user.

The toothbrush in accordance with the invention operates in the following manner.

A user takes the toothbrush with its hand by grasping the lower part 8 and brushes the teeth with the toothbrushing element 3. After the toothbrushing, the user places the toothbrush by putting a surface 6 of the lower part 8 on a supporting surface, and the toothbrush assumes an upright position and stands in this position.

Figure 4:
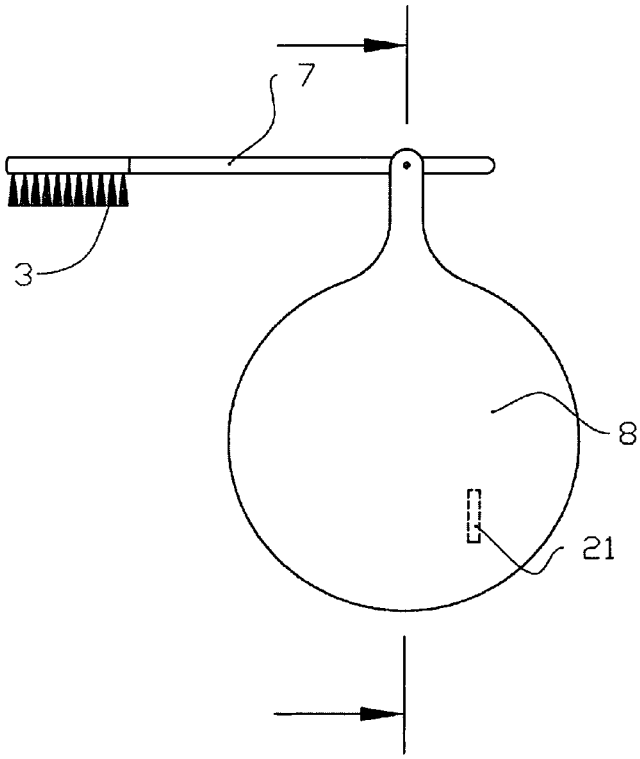
FIG. 4 is a view showing the toothbrush in accordance with the present invention with an upper part in a substantially horizontal position.

As shown in FIG. 4, the upper part 7 can be turned so that the toothbrushing element 3 faces downwardly and residues can drip down from it. The upper part 7 is kept in this position due to the tight fit of the connecting means, which allow turning of the upper part 7 and at the same time keep it in the position shown in FIG. 4.

The upper part 7 with the toothbrushing element 3 can be removed from the lower part 8 by unscrewing of the threaded pin 12. Then a new upper part 7 with a new toothbrushing element 3 can be introduced between the projections 10 and 11, and the threaded pin 12 can be passed through the opening of the new upper part 7 and screwed into the projections 10 and 11.

Figure 5:
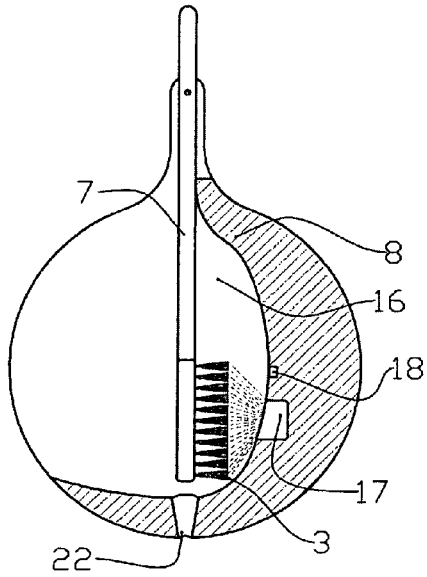
FIG. 5 is a view showing the toothbrush in accordance with the present invention with the upper part pivoted downwardly.

As shown in FIG. 5, the upper part 7 can be pivoted downward so that the toothbrushing element 3 is received in a receptacle 16 formed in the lower part 8. In this position the toothbrushing element 3 can be sterilized by a source of ultraviolet light 17 located in the lower part 8 and directing the ultraviolet light to the toothbrushing element 3. The operation of the source of the ultraviolet light 17 can be triggered by a sensor 18 which senses the presence of the toothbrushing element 3 in the receptacle 16.

A light source 19 can be also provided in the toothbrush and arranged, for example, in the lower part 8. The light source 19 can be programmed so that it emits light, for example, during the time required for brushing teeth, for example, 3 min. Thereafter it turns off automatically. The turning on of the light source 19 can be triggered for example, by a sensor 20, which senses holding of the lower part 8 by a user.

It will be understood that each of the elements described above, or two or more together, may also find a useful application in other types of constructions differing from the type described above.

While the invention has been illustrated and described as embodied in a toothbrush, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A toothbrush placeable on a supporting surface, comprising a first upper part provided at its upper end with a toothbrushing element and a second lower part moveably connected with a lower end of said first upper part and formed as a bulbous part composed of one piece only and having a curvilinear part-spherical lower surface with a substantially circular vertical cross section and a lowest point placeable directly on the supporting surface and also having a low location of a center of gravity so that when said second one-piece bulbous lower part is deviated from a substantially vertical orientation it automatically turns back around a horizontal axis over the curvilinear part-spherical surface to the vertical orientation to prevent a contact of said toothbrushing element of said first upper part with the supporting surface.

2. A toothbrush as defined in claim 1, wherein said second lower part has a recess, and said first upper part is turnable relative to said second lower part between a first position in which said first upper part extends vertically upwardly and said toothbrushing element is in an upper location ready to brush teeth, a second position in which said first upper part extends substantially horizontally and said toothbrushing element faces downwardly for dripping of residues therefrom, and a third position in which said first upper part extends vertically downwardly and said toothbrushing element is located in said recess.

3. A toothbrush as defined in claim 2, further comprising pivot means turnably connecting said first upper part with said second lower part and providing between said first upper part and said second lower part a tight fit such that said first upper part is retained in each of said three positions relative to said second lower part exclusively by said tight fit and without any additional retaining elements.

4. A toothbrush as defined in claim 2, further comprising an ultraviolet light source arranged in said recess of said second lower part and operative for sterilizing said toothbrushing element when said first upper part is in said third position and said toothbrushing element is located in said recess of said second lower part.

5. A toothbrush as defined in claim 1, further comprising a light source programmable to emit light during a time required for brushing of teeth, and a sensor sensing holding said second lower part by a user and turning off said light source when said second lower part is no longer held by the user.

* * * * *